United States Patent [19]

Lightell

[11] 4,255,907

[45] Mar. 17, 1981

[54] INFLATABLE STORM WINDOW

[76] Inventor: Wilbur G. Lightell, 138 Sheldon Ave., Pittsburgh, Pa. 15220

[21] Appl. No.: 957,484

[22] Filed: Nov. 3, 1978

[51] Int. Cl.[3] ..... E06B 3/26

[52] U.S. Cl. ..... 52/2; 52/202; 160/90

[58] Field of Search ..... 52/2, 202; 160/90

[56] References Cited

U.S. PATENT DOCUMENTS

| | | | |
|---|---|---|---|
| 2,682,274 | 6/1954 | Miller | 52/2 |
| 2,825,941 | 3/1958 | Lux et al. | 52/2 |
| 2,896,272 | 7/1959 | Latenser | 52/2 X |
| 2,935,769 | 5/1960 | Lutes | 52/202 |
| 2,990,837 | 7/1961 | Cushman | 52/2 |
| 3,911,630 | 10/1975 | Nally | 52/2 |
| 4,020,607 | 5/1977 | Bjervig | 52/2 X |
| 4,040,210 | 7/1977 | Land | 52/2 |
| 4,098,035 | 7/1978 | Bessler | 52/2 |

FOREIGN PATENT DOCUMENTS

| | | | |
|---|---|---|---|
| 641647 | 7/1967 | Italy | 52/2 |

*Primary Examiner*—Alfred C. Perham
*Attorney, Agent, or Firm*—Clifford A. Poff

[57] ABSTRACT

An inflatable storm window includes flexible and transparent front, back and side walls made from plastic material. Interior spacing support walls made from the same material provide rigidity. The walls are joined together in an airtight manner forming an inflatable box-shaped storm window to fit within a window opening. A valve extends from one of the side walls to admit air or some other gas to inflate the storm window in situ. A compressible seal member is adhered to the side walls about the entire periphery of the storm window for sealing within the window opening.

6 Claims, 3 Drawing Figures

INFLATABLE STORM WINDOW

BACKGROUND OF THE INVENTION

Figure 1:
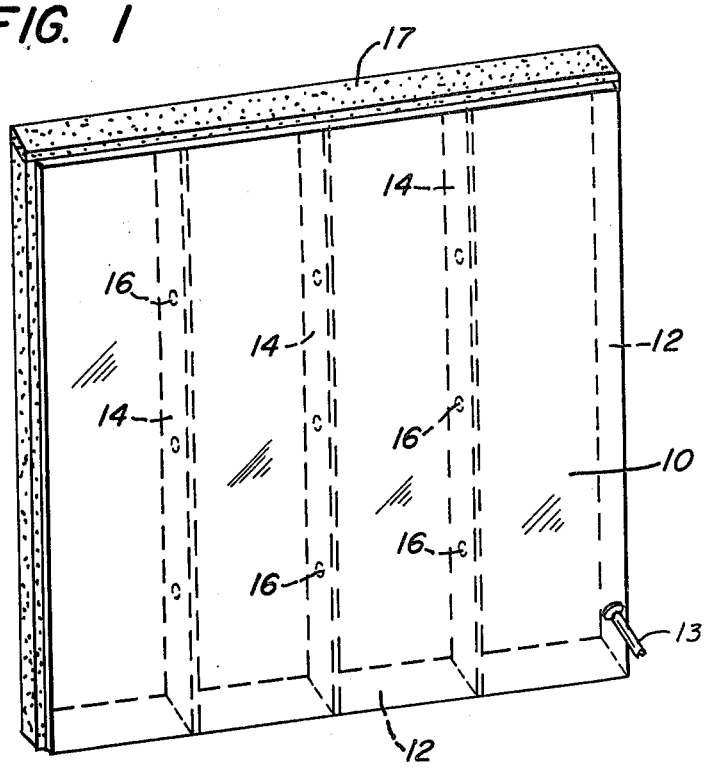

This invention relates to a flexible storm window having transparent side walls forming an airtight internal space communicating with a valve member to conduct an inflating medium into the internal space for expansive support within a window opening.

Conserving energy used for heating and cooling buildings is a present-day national objective. Industry and, especially, homeowners face ever-increasing costs for energy, as well as costly conservation measures. Storm windows are usually costly but an effective barrier against the unwanted flow of heat. The stagnated airspace created by a storm window prevents escapement of heat from a dwelling during winter in a cold climate and prevents the ingress of heat into a dwelling during summer in a warm climate. Storm windows known in the art are expensive, difficult to install, a safety hazard and require continued maintenance to insure an attractive appearance. Moreover, most storm windows are not easily stored; sometimes requiring valuable storage space.

A conventinal and costly storm window consists of a rigid transparent panel surrounded by a frame which is, in turn, supported by a frame attached to the building structure outwardly of the usual window. Another prior art form of storm window is shown in U.S. Pat. No. 3,911,630. This form of storm window has a very limited field of use and is not compatible with conventional window assemblies and window openings according to present-day constructions. The rigid sheet of transparent material in the storm window construction is undesirable from the standpoint of safety and prohibits installation over the exterior or interior of the window opening. In most buildings, the exterior windowsill or interior sill stool projects outwardly beyond the wall of the building; thus preventing positive sealing. The straition type of seal for the storm window is ineffective for window openings in brick, stone or concrete. Moreover, wooden window frames, e.g., double-hung windows, project at various levels or planes. This storm window design is believed costly to manufacture and install.

SUMMARY OF THE INVENTION

It is an object of the present invention to provide an attractive and safe flexible storm window for inflatable support within a window opening without tools and easily stored due to the lightweight collapsible design.

It is a further object of the present invention to provide a flexible storm window for inflated support and sealing within a window opening of widely varying designs and constructions to form an effective barrier against the flow of heat.

More particularly, according to the present invention, there is provided a flexible storm window apparatus for inflated support against surfaces of a window opening, the flexible storm window apparatus including the combination of two rectangular flexible facing sheets for extending in a generally spaced-apart and face-to-face relation, flexible side walls joined to the peripheral edges of the flexible rectangular facing sheets to define therewith an internal airtight space forming a thermal barrier against heat flow, spacing support means interconnecting the rectangular facing sheets within the internal airtight space for spacing and support of the flexible facing sheets, valve means to admit a gaseous medium into the internal airtight space under a sufficient pressure for inflated support against surfaces of a window opening, and a seal member extending along the outer face of the flexible side walls for interface sealing between the side walls and the support surfaces therefor defined by the window opening.

In the preferred form of the present invention, the aforesaid facing sheets and side walls are made from transparent plastic material and include marginal edges for heat welding together to form the airtight internal air space. The spacing support means preferably takes the form of parallel and spaced-apart transparent strips with gaseous permeable openings. The strips are joined by heat welding to facing sheets and, if desired, to opposed side walls to provide internal support for the inflatable storm window. The seal member is typically polyurethane foam to provide a compression seal adaptable to rough and irregular contours. Such a seal avoids rupture of the side wall of the storm window by an irregular or sharp protrusion.

Figure 2:
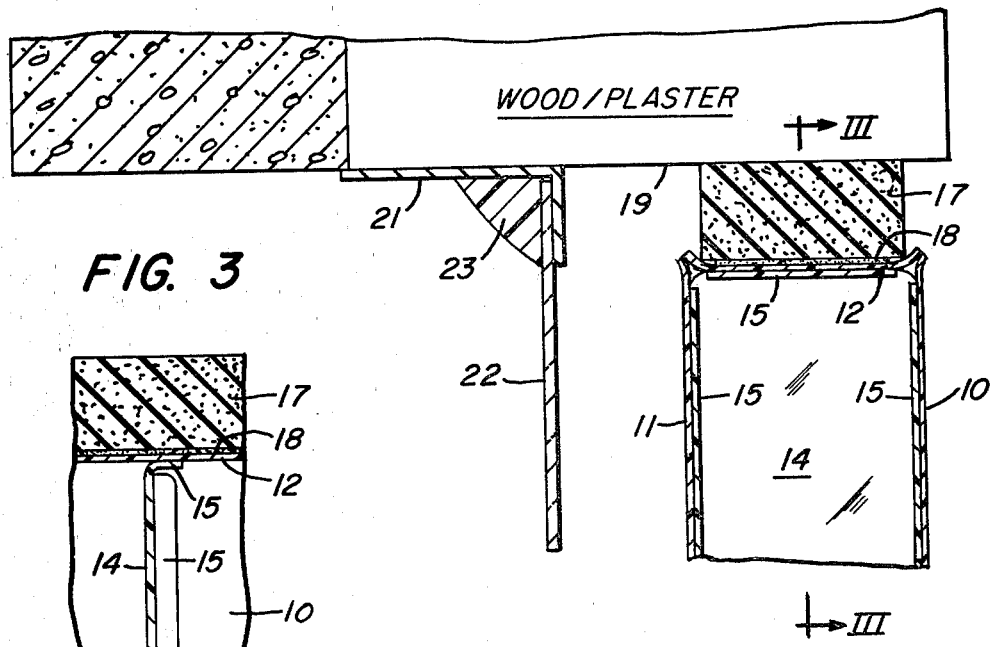
Figure 3:
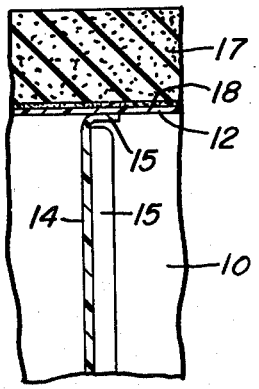

The above and other objects and features of the invention will become apparent from the following detailed description taken in connection with the accompanying drawings which form a part of this specification and in which:

FIG. 1 is a perspective elevational view of the storm window apparatus according to the present invention, FIG. 2 is an elevational view in section illustrating the supported relation of the storm window in a window opening for a casement type window assembly, and FIG. 3 is a sectional view taken along line III—III of FIG. 2.

The preferred embodiment of the flexible storm window shown in FIGS. 1–3 includes facing sheets 10 and 11 made from plastic material in a rectangular shape which includes the possibility of a square shape. The facing sheets 10 and 11 each include bent over edge portions that are cemented, heat welded or otherwise secured in an airtight manner to flexible side walls 12. The side walls may be made from one continuous strip, if desired. The side walls form vertical sides as well as top and bottom sides and define, together with the facing sheets, a boxlike configuration to the storm window with an internal airtight space. A check-type air valve 13 communicates with the internal air space of the storm window through a wall thereof, preferably one of facing sheets 10 or 11. To provide necessary support for the storm window because of its construction from flexible transparent sheets, spacing support strips 14 extend within the internal airtight space. In FIG. 1, three spacing support strips are shown in a vertically spaced-apart relation. Each strip 14 has bent over edge portions 15 for attachment to the facing sheets 10 and 11 and opposite ones of the side walls. The facing sheets may include aligned crimped surfaces to receive the opposite edges of each strip 14 in which event the bent over edge portions may be eliminated, if desired. To accommodate the necessary flow of a gaseous medium such as air which is introduced through valve 13 into the various spaces formed between support strips 14, openings 16 are provided at spaced-apart locations along each of the strips.

A compressible seal 17 is adhered by a layer of adhesive 18 about the entire periphery of the storm window. The seal is used for providing an innerface seal between the side walls of the storm window and the support surface as provided typically by plaster, brick, stone, concrete or wood. A support surface is indicated in FIG. 2 by reference numeral 19. This support surface extends horizontally from a frame member 21 used to retain a casement-type windowpane 22 within a window opening. The usual bead of putting 23 or the like is illustrated in FIG. 2. As can be seen from the illustration of FIG. 2, two dead air spaces are provided, namely, a first dead air space formed between internal airtight spaces in the storm window and a second dead air space between the storm window and the windowpane 22.

The storm window of the present invention can be used with essentially any type of window, such as wood, double-hung, steel casement, aluminum casement and glass block. Use of the storm window is not dependent on the type of window or frame used for the windowpane. The inflatable storm window may be inflated in situ or, if desired, at any convenient place before mounting within the window opening. The inflatable storm window is readily used at the internal side of windows but is equally useful at the external side of permanent windows, for example. The seal 17 readily adapts under pressure imposed by the inflating medium within the storm window to irregularities of the support surface. The materials used to form the storm window are preferably transparent plastic with a suitable thickness to withstand nominal air pressure. The storm window of the present invention is therefore lightweight and unbreakable since the use of glass or rigid plastic sheets is eliminated. Safety is greatly enhanced by the elimination of glass and sharp edges. Moreover, the window can be instantaneously removed in the event of an emergency.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A flexible storm window apparatus for inflated support against surfaces of a window opening; said flexible storm window apparatus including the combination of:

two rectangular flexible facing sheets of transparent plastic material extending in a generally spaced-apart and face-to-face relation, flexible side walls joined to the peripheral edges of said flexible rectangular facing sheets to define therewith an internal airtight space formed a thermal barrier against heat flow, some of said side walls being heat welded to at least on of said facing sheets, a plurality of discrete spacing support strips having opposed longitudinal marginal edge portions secured by heat welding to the face surfaces of said rectangular facing sheets, said spacing support strips having a gas permeable opening and extending within said internal airtight space at spaced-apart locations from some of said flexible side walls and between other of such walls to space and support said flexible facing sheets, valve means to admit a gaseous medium into said internal airtight space under a sufficient pressure for inflated support against surfaces of a window opening, and an interface seal strip extending along the outer face surfaces of said flexible side walls to prevent rupture of said side wall of the airtight space for interface sealing between said side walls and the support surfaces therefor defined by the window opening.

2. The flexible storm window apparatus according to claim 1 wherein said valve means extends through one of said flexible facing sheets.

3. The flexible storm window apparatus according to claim 1 wherein said spacing support strips have ends adjoined to said flexible side walls.

4. The flexible storm window apparatus according to claim 1 wherein said seal member consists of polyurethane foam.

5. The flexible storm window apparatus according to claim 1 wherein said flexible facing sheets consist of polyethylene.

6. The flexible storm window apparatus according to claim 1 wherein said flexible facing sheets have aligned crimped surfaces to support said spacing support means.

* * * * *

UNITED STATES PATENT OFFICE

CERTIFICATE OF CORRECTION

Patent No. 4,255,907 Dated March 17, 1981

Inventor(s) Wilbur G. Lightell

It is certified that error appears in the above-identified patent and that said Letters Patent are hereby corrected as shown below:

Column 3, line 7, cancel "putting" and substitute -- putty --.

Column 4, line 8, cancel "formed" and substitute -- forming --.

Column 4, line 10, cancel "on" and substitute -- one --.

Signed and Sealed this

*Sixth* Day of *October 1981*

[SEAL]

*Attest:*

GERALD J. MOSSINGHOFF

*Attesting Officer* *Commissioner of Patents and Trademarks*